US008234724B2

(12) United States Patent
Wilson et al.

(10) Patent No.: US 8,234,724 B2
(45) Date of Patent: Aug. 7, 2012

(54) AUTOMATIC DUAL FLUSH ACTIVATION

(75) Inventors: John R. Wilson, Naperville, IL (US); Peter J. Jahrling, Park Ridge, IL (US)

(73) Assignee: Sloan Valve Company, Franklin Park, IL (US)

( * ) Notice: Subject to any disclaimer, the term of this patent is extended or adjusted under 35 U.S.C. 154(b) by 990 days.

(21) Appl. No.: 11/863,195

(22) Filed: Sep. 27, 2007

(65) Prior Publication Data

US 2008/0078014 A1 Apr. 3, 2008

Related U.S. Application Data

(60) Provisional application No. 60/848,439, filed on Sep. 29, 2006.

(51) Int. Cl.
*E03D 1/00* (2006.01)

(52) U.S. Cl. ..... 4/313; 4/302; 4/DIG. 3

(58) Field of Classification Search ..... 4/313, 314, 4/302–305, DIG. 3

See application file for complete search history.

(56) References Cited

U.S. PATENT DOCUMENTS

| | | | |
|---|---|---|---|
| 605,621 | A | 6/1898 | Acklin |
| 934,353 | A | 9/1909 | Prichett |
| 1,114,398 | A | 10/1914 | Sloan |
| 1,323,703 | A | 12/1919 | Linfoot |
| 1,519,654 | A | 12/1924 | Banta |
| 1,868,520 | A | 7/1932 | Brooks |
| 1,868,591 | A | 7/1932 | Tanner |
| 1,896,950 | A | 2/1933 | Groeniger |
| 1,912,937 | A | 6/1933 | George |
| 1,992,381 | A | 2/1935 | Lyons |
| 2,038,135 | A | 4/1936 | Sloan |
| 2,136,221 | A | 11/1938 | Sloan |
| 2,164,760 | A | 7/1939 | Wesson |
| 2,369,104 | A | 2/1945 | Frederickson |
| 2,472,576 | A | 6/1949 | Dobrick |
| 2,511,545 | A | 6/1950 | Roselair |
| 2,612,187 | A | 9/1952 | Romanelli et al. |
| 2,734,712 | A | 2/1956 | Fraser |
| 2,738,946 | A | 3/1956 | Filliung |
| 2,775,772 | A | 1/1957 | Clarke |
| 2,858,846 | A | 11/1958 | Parker |
| 3,026,536 | A | 3/1962 | Wood |
| 3,085,779 | A | 4/1963 | Philippe |
| 3,141,177 | A | 7/1964 | Kertell |
| 3,207,467 | A | 9/1965 | Bühler |
| 3,334,359 | A | 8/1967 | Weingartner |
| 3,365,730 | A | 1/1968 | Chiappetta |
| 3,380,077 | A | 4/1968 | Armstrong |
| 3,399,860 | A | 9/1968 | Billeter et al. |
| 3,406,940 | A | 10/1968 | Kertell |

(Continued)

FOREIGN PATENT DOCUMENTS

| | | |
|---|---|---|
| EP | 0 331 461 | 9/1989 |

(Continued)

*Primary Examiner* — Gregory Huson
*Assistant Examiner* — Karen L Younkins
(74) *Attorney, Agent, or Firm* — Foley & Lardner LLP

(57) ABSTRACT

A multi flush volume flush valve is in communication with an automatic flush control. The flush control determines the presence of a user and the amount of time the user uses the toilet. The usage time is compared to a predetermined time value to determine the appropriate flush volume based on an assumption regarding usage time and flush volume needs. The comparative value statistically adjusts to the restroom traffic.

8 Claims, 3 Drawing Sheets

U.S. PATENT DOCUMENTS 3,419,912 A 1/1969 Kertell
3,695,254 A 10/1972 Blum
3,745,591 A 7/1973 Girten
3,775,778 A 12/1973 Lee
3,778,023 A 12/1973 Billeter
3,787,902 A 1/1974 McCombs
3,806,962 A 4/1974 Sievers
4,025,968 A 5/1977 Davis
4,080,669 A 3/1978 Biggerstaff
4,101,986 A 7/1978 Ng et al.
4,114,204 A 9/1978 Blach
4,134,570 A 1/1979 Walker
4,135,263 A 1/1979 Anderson
4,160,294 A 7/1979 Crumby
4,202,525 A 5/1980 Govaer et al.
4,240,168 A 12/1980 Duke
4,272,052 A 6/1981 Gidner
4,327,891 A 5/1982 Allen et al.
4,576,272 A 3/1986 Morgan, Jr. et al.
4,817,913 A 4/1989 Whiteside
4,883,254 A 11/1989 Whiteside
4,893,645 A 1/1990 Augustinas et al.
4,971,094 A 11/1990 Gonzalez
5,026,021 A 6/1991 Pino
5,062,453 A 11/1991 Saadi et al.
5,125,621 A * 6/1992 Parsons et al. ..... 4/DIG. 3
5,187,818 A 2/1993 Barrett, Sr. et al.
5,224,685 A * 7/1993 Chiang et al. ..... 4/304
5,244,179 A 9/1993 Wilson
5,415,374 A 5/1995 Carroll et al.
5,431,181 A 7/1995 Saadi et al.
5,469,586 A * 11/1995 Tsutsui et al. ..... 4/DIG. 3
5,476,244 A 12/1995 Carroll et al.
5,482,250 A * 1/1996 Kodaira ..... 4/304
5,497,802 A 3/1996 Whiteside
5,505,427 A 4/1996 Whiteside
5,535,781 A 7/1996 Paterson et al.
5,603,127 A 2/1997 Veal
5,730,415 A 3/1998 Gronwick
5,881,993 A 3/1999 Wilson et al.
6,019,343 A 2/2000 Tsai
6,056,261 A 5/2000 Aparicio et al.
6,094,753 A 8/2000 Korte
6,112,763 A 9/2000 Orbell
6,173,456 B1 1/2001 Nieto
6,178,567 B1 1/2001 Bliss
6,189,554 B1 2/2001 Pino
6,227,219 B1 5/2001 Pino
6,250,601 B1 6/2001 Kolar et al.
6,263,520 B1 7/2001 Song
6,282,731 B1 9/2001 Mohrman
6,299,127 B1 10/2001 Wilson
6,317,899 B1 11/2001 Brewer
6,336,229 B1 1/2002 Guo
6,385,786 B1 5/2002 Lester
6,408,873 B1 6/2002 Hall et al.
6,442,772 B2 9/2002 Han et al.
6,467,100 B2 10/2002 Leach
6,484,327 B2 11/2002 Hand
6,499,152 B2 12/2002 Johnson
6,510,563 B1 1/2003 Jarosinski et al.
6,549,816 B2 * 4/2003 Gauthier et al. ..... 4/302
6,554,018 B1 4/2003 Pino
6,560,790 B2 5/2003 Saar et al.
6,604,249 B2 8/2003 Han et al.
6,643,855 B1 11/2003 Huang
6,651,265 B2 11/2003 Kwen
6,704,945 B2 3/2004 Bellmore
6,729,602 B2 5/2004 Hankin, Jr. et al.
6,823,534 B2 11/2004 Li
6,829,787 B1 12/2004 Pipenburg
6,898,808 B2 5/2005 Molho et al.
6,905,108 B2 6/2005 Hall et al.
7,062,801 B2 6/2006 Oliver
2002/0162166 A1 * 11/2002 Saar et al. ..... 4/302
2003/0110555 A1 6/2003 Tate
2004/0232370 A1 11/2004 Parsons et al.
2005/0050625 A1 3/2005 Bayer
2006/0033060 A1 2/2006 Funari
2006/0151729 A1 7/2006 Wilson
2007/0151008 A1 7/2007 Hayashi et al.

FOREIGN PATENT DOCUMENTS

GB 2 358 413 A 7/2001
GB 2 392 454 A 3/2004
WO WO 01/73228 A1 10/2001
WO WO 2005/012659 A1 2/2005
WO WO 2005/124210 A1 12/2005

* cited by examiner

AUTOMATIC DUAL FLUSH ACTIVATION

CROSS-REFERENCE TO RELATED PATENT APPLICATION

This application claims priority from U.S. Provisional Patent Application No. 60/848,439, filed Sep. 29, 2006, herein incorporated by reference in its entirety.

FIELD OF THE INVENTION

The present invention relates generally to the field of flush valves in general. More particularly, the present invention relates to automatic control of a multiple-volume flush valve.

BACKGROUND OF THE INVENTION

Flush valves are used selectively to control the flushing of a urinal or toilet with a certain fixed volume of water. Typically, flush valves include a flexible diaphragm which forms a seal between the inlet and outlet, whereby a disruption of the diaphragm will result in a flow of water into the urinal or toilet to evacuate the waste.

Commercial toilets and urinals have traditionally utilized a single flush volume in their operations. This flush volume is designed to provide the maximum amount of water needed that may be needed to clear solid waste products. However, solid waste and liquid waste generally require different volumes of water to be cleared from the bowl. In a single flush system, the higher volume of water necessary to flush solid waste is also used to flush liquid waste, with the result that more water than is necessary is often used. Ideally, the smallest amount of water necessary to achieve an adequate flushing of the waste would be utilized.

While a multi-flush volume valve allows for a more efficient flush, it only achieves this efficiency if the appropriate flush mode is used with current multi-flush volume valves that are manually activated. In such systems, the proper flush volume is determined by the user; thus, manual actuation of the flush valve often results in an improper choice of flush volume. Users may be unaware of the dual flush system and, thus, do not appropriately use it. In addition, users may be aware of the system, but simply give no thought to how they are actuating the flush valve, but instead activate the device as they have in the past. Thus, there is a need for an automatic dual flush volume valve which allows for the selection of an appropriate flush volume based on the specific fixture use. Additionally, there is a need for an automatic dual flush volume valve that makes the proper decision of flushing volume.

SUMMARY OF THE INVENTION

One embodiment of the invention relates to an automatic system and method for automatically selecting between at least two flush volumes of gallons per flush ("gpf"). The system includes a multi-volume flushometer in operative communication with a flush control apparatus. The flush control apparatus determines if a user is present; and if the user is present, a timer is started. When the user is no longer detected, the timer is stopped and the elapsed time obtained is the usage time for that particular use. That usage time is compared to a predetermined usage time to determine the appropriate volume of flush to deliver.

These and other objects, advantages, and features of the invention, together with the organization and manner of operation thereof, will become apparent from the following detailed description when taken in conjunction with the accompanying drawings, wherein like elements have like numerals throughout the several drawings described below.

DETAILED DESCRIPTION OF THE PREFERRED EMBODIMENTS

Figure 1:
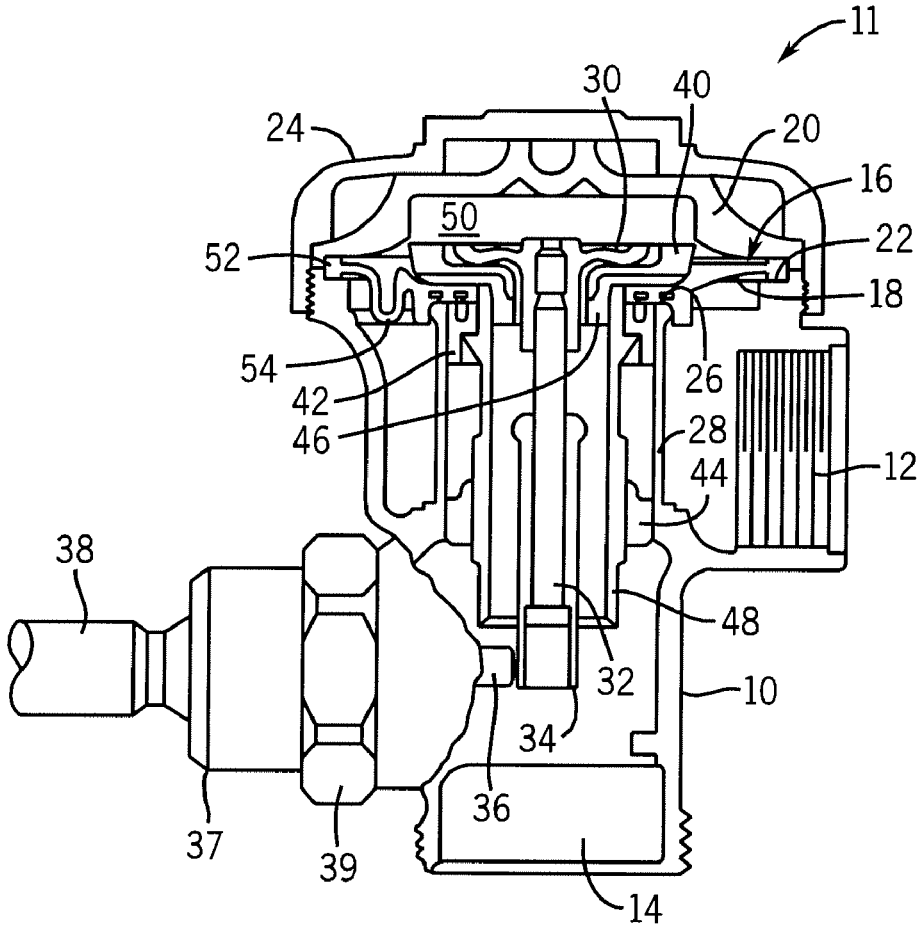
FIG. 1 is a cross-sectional view of a valve in accordance with one form of the invention.

The present invention relates to a flush valve system having at least two gallons per flush volumes (gpf, gallons per flush). Flush valve systems are generally known in the art, for example U.S. Pat. App. Pub. No. 2006/0151729, incorporated herein by reference. In addition, automatic sensor based flush valve actuation is also generally known, see for example U.S. Pat. No. 6,978,490, incorporated herein by reference. FIG. 1 illustrates one embodiment of a flushometer 11 of the present invention which includes a body 10 having an inlet 12 and an outlet 14. When installed the inlet 12 is connected to a water supply (not shown); and the outlet 14 is connected to a fixture (not shown) such as a toilet or urinal. A valve kit assembly is indicated generally at 16, and the valve kit assembly 16 generally includes a retaining disk, relief valve, sleeve guide, refill head, and a flow control ring. In the illustrated embodiment the valve kit assembly 16 comprises a diaphragm assembly 18. However, this could be other components well known in the art, such as a piston assembly (not shown), which meters water using a piston rather than a diaphragm. The valve kit assembly 16, shown in FIG. 1, includes a diaphragm 19 peripherally held to the body 10 by an inner cover 20. The diaphragm 19 is seated upon a shoulder 22 at the upper end of the body 10 by an inner cover 20. The diaphragm edge 52 of the diaphragm 19 is clamped in this position by the inner cover 20. An outer cover 21 is screw threaded onto the body 10 to hold the inner cover 20 in position compressing the diaphragm edges between the inner cover 20 and the shoulder 22.

The diaphragm assembly 18, as shown in FIG. 1, is closed upon a valve seat 26 formed at the upper end of a barrel 28. The barrel 28 forms the fluid conduit connecting the valve seat 26 with the outlet 14. The diaphragm assembly 18 further includes a relief valve 30 having a downwardly extending stem 32 telescopically carrying a movable sleeve 34. A handle assembly 37 of the present embodiment is described in further detail below. In general, a handle 38 is provided to actuate a plunger 36. The sleeve 34 is positioned for contact by the plunger 36 when operated by the handle 38. In one embodiment, the handle assembly 37 is retained on the body 10 by a nut 39.

The diaphragm assembly 18, in addition to the diaphragm 19 and the relief valve 30, includes a retaining disk 40, a refill ring 42 and a flow control ring 44. The underside of the retaining disk 40 is threadedly attached to a collar 46, which in turn is threadedly attached at its exterior to a sleeve guide 48 which carries the refill ring 42. The above described assembly of elements firmly holds the diaphragm 19 between an upper face 41 of the refill ring 42 and a lower facing surface 43 of the collar 46. Above the diaphragm assembly 18 is a pressure chamber 50 which maintains the diaphragm assembly 18 in a closed position when the flush valve 11 is not in use and the water supply is under pressure.

As is known in the art, when the handle 38 is operated, the plunger 36 will contact sleeve 34, tilting the relief valve 30 off its seat on the retaining disk 40. This will permit the discharge of water within the pressure control chamber 50 down through the sleeve guide 48. Inlet pressure will then cause the diaphragm 19 to move upwardly off the valve seat 26, permitting direct water communication between the inlet 12 and the outlet 14 through the space between the bottom of the diaphragm assembly 18 and the valve seat 26. The raising of the diaphragm 19 also lifts the relief valve sleeve 34, allowing it to clear the plunger 36 even if the user maintained the handle 38 in an actuated position. Once the valve sleeve 34 clears the plunger 36, the relief valve 30 reseats on the retaining disk 40. As soon as this operation has taken place, the pressure control chamber 50 will begin to fill through the filter 40 and bypass orifice 54 in the diaphragm assembly 18. As flow continues into the pressure chamber 50, the diaphragm assembly 18 will move back down toward the valve seat 26; and when it has reached that position, the flush valve 11 will be closed.

Various methods for achieving a plurality of flush volumes are known in the art. For example, U.S. Pat. App. Pub. No. 2006/0151729, which has been incorporated by reference, teaches angling the plunger to strike the stem at different points. The present invention is applicable with a wide variety of the known methods of providing multiple flush volumes.

In one embodiment of the present invention, systems and methods are used for determining the appropriate flush volume to apply using a multi-volume flushometer such as, but not limited to, those previously discussed. In one embodiment, the system includes a mechanism for determining the presence of a user. While there are a multitude of presence-aware sensors, examples of sensors that could be used with the present invention include: infrared, capacitance, weight, thermal, motion, and combinations thereof. Upon determination of presence, by a sensor, of a user, the system starts a timer. When the user is no longer detected, the timer is stopped to determine an elapsed "usage" time. This time is representative of the time the user was using the plumbing fixture. Given that a longer usage time tends to indicate solid waste rather than only liquid waste, a longer usage time will trigger a heavier flush volume.

In one embodiment, the system "learns" by averaging prior liquid uses and prior solid waste uses to determine the unique average for each type of use for that particular installation at that particular time. It will be appreciated that each installation of urinal or water closet may experience a unique use profile. For example, usage patterns concerning the type of waste may vary based on the relative position of the installation in the restroom.

By determining the usage time, designated $t_x$, whenever an installation is used, the type of use (i.e. solid or liquid) can be ascertained and the appropriate flush volume used. In one embodiment, the time tx is compared to a predetermined average usage time above which represents solid waste and below which represents liquid waste. In a further embodiment, a unique average liquid waste and average solid waste usage times can be determined for each installation, designated $t_l$, and $t_s$, respectively. In one embodiment, time $t_x$ is compared to the predetermined average liquid waste usage time $t_l$, wherein if the usage time is less than or equal to the time $t_l$, a reduced flush volume is appropriate. In another embodiment, the usage time $t_x$ is compared to an average solid waste usage time $t_s$, wherein if the usage time is more than the average solid waste usage time $t_s$, a full flush volume is used.

In should be appreciated that in certain embodiments, initial "seed" values representing the liquid waste time and solid waste time are necessary. For example, when the system is first installed, no prior average usage time $t_s$ or $t_l$ will have been determined. Therefore, the system may be provided with preset times $T_l$ and $T_s$, or even a $T_p$ (singular system present value for comparison) which take the place of system averaged $t_l$ and $t_s$, respectively, for determining the appropriate flush volume. In an exemplary embodiment, the preset value $T_l$ is used upon power start up to represent detection time for solid waste evacuation. As mentioned before, a suitable substitute for this could be a singular system start up value $T_s$ for comparison until the database is large enough to generate $t_l$ and $t_s$. This value is used as the seed value (i.e. the initial starting point into which actual usage times $t_x$ are compared against) for determining when to flush a reduced volume. Similarly, the preset value $T_l$ is used upon power start up to represent detection time for liquid waste evacuation. The value $T_l$ is used as a seed value (i.e. the initial starting point into which actual usage values $t_x$ are later averaged into) for averaging liquid waste flush time average. As with $t_s$ and $t_l$, in an exemplary embodiment, $Ts>T_l$. $t_l$ is the system average time calculated beyond a default start up value to use as comparison to determining liquid waste flushing condition, i.e. $T_l<T_s$ embedded within the electronic flushometer logic is a routine called reduced flush logic. Thus, $T_l$ or $T_s$ are initially the values that $t_x$ is compared against.

In an exemplary embodiment, the system includes a counter $N_c$ that keeps track of the number of flush cycles that the system has undergone since startup. Each time a new $t_x$ is determined, $N_c$ is recalculated such that $N_c=N_c+1$. Nc is compared to a system assigned value $N_p$ to determine when a significant sample size of times $t_x$ has been accumulated. $N_c$ can also be used as appropriate statistical values are necessary for the averaging routines. While the preset values $T_l$ and $T_s$ are used, the usage time $t_x$ for each use event is still used for averaging. For example, an initial usage event following installation of the system will utilize the preset values to determine the flush value. However, the usage time for that event $t_x$ will be averaged in to the appropriate preset value of $T_l$ or $T_s$ (depending on whether $t_x$ was greater or less than $T_l$) resulting in one of $t_s$ or $t_l$ as appropriate. This process continues with the preset values serving as the initial seed for the averaging of $t_x$ to form $t_s$ and $t_l$ (with each subsequent usage averaging the new $t_x$ into the $t_s$ or $t_l$ calculated originally from the preset value) and also being used to determine the flush volume (rather than the averages $t_l$ and $t_s$ which are being calculated "in the background").

In an exemplary embodiment, after a preset number of cycles $N_p$, i.e. when $N_c$ is greater than $N_p$, the system switches to using $t_l$ and $t_s$ to determine the flush volume rather than the preset values $T_l$ and $T_s$. It will be appreciated that the number of cycles prior to the averages being used may be selected depending on the particular applications such that where usage times vary widely, a larger number of cycles are requires before the average is used and where usage times are consistent, a relatively fewer number of cycles are required prior to the averages being used.

In one embodiment, the device may trigger a flush of a specific volume after a predetermined amount of time even if the user is still detected. Such an intra-usage flush would serve to prevent clogging of the device where a large amount of material is being deposited. It should be appreciated that such a intra-usage flush should be of a minimal volume so as not to disturb the user.

Figure 2:
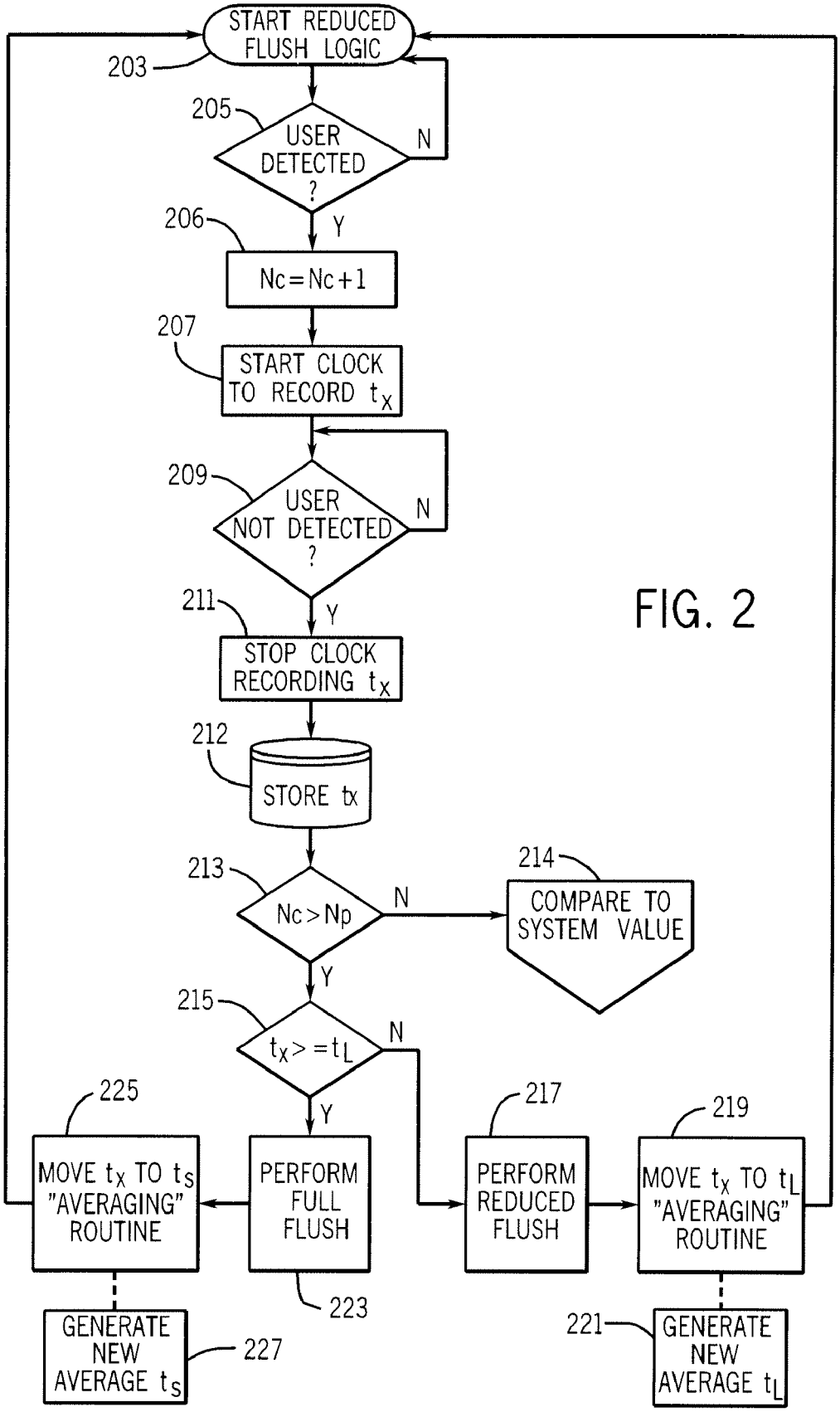
FIG. 2 is a flow chart depicting a system in accordance with the principles of one embodiment of the present invention.

FIG. 2 illustrates a flow chart of the logic for one embodiment of the present invention. The reduced flush logic is started at step 203 in FIG. 2. Next determination of a valid target (user) takes place at step 205. If no user is present, then the process logic jumps by returning back to step 203, essentially cycling until a user is detected. If a user is detected at step 205, then the $N_c$ counter is indexed at step 207 and then a timer is started at step 207 to determine $t_x$. When a user is no longer detected at step 209, the timer is stopped at step 211, setting $t_x$. In one embodiment, the time $t_x$ for the first use after power up of the device is compared to the system "seed" value $T_L$; after a predetermined number of usage cycles (chosen to provide a statistically significant averaging value), all subsequent comparisons are against the average $t_L$ rather than the seed value $T_L$. In one embodiment, the time, $t_x$, is stored at step 212. At step 213, the counter $N_c$ is compared to a preset value $N_p$ such that if the counter is greater than the preset value, then the system moves to step 215 to compare $t_x$ to the average value $t_l$, but if $N_c$ is less than $N_p$, the systems moves to step 214 for the comparison subroutine using the seed value $T_L$.

Figure 3:
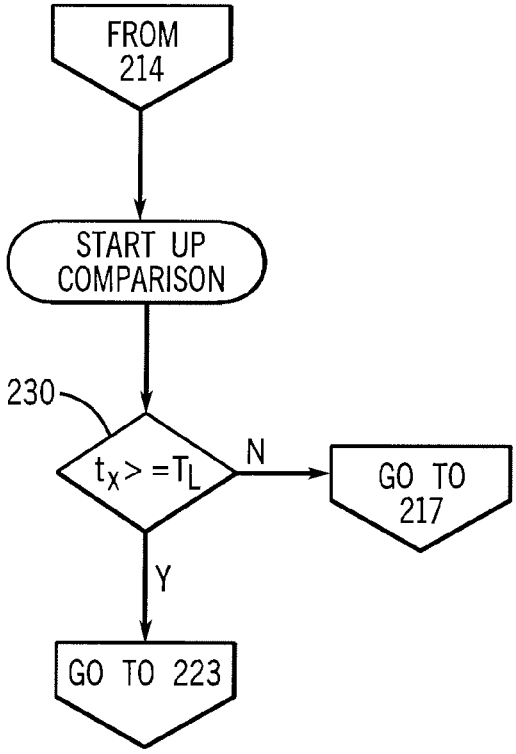
FIG. 3 is a flow chart depicting the conditional subroutine logic for initial startup of the system comparison values.

FIG. 3 illustrates the subroutine for step 214 where at step 230 $t_x$ is compared to $T_L$, and if it is greater than or equal to $T_L$, the system goes to step 223 for a full flush and if less than, to step 217 for a reduced flush.

The time $t_x$ is compared to $T_l$ at step 215. If $t_x$ is less than $t_l$, then a reduced volume flush is performed at step 217. In one embodiment, the time, $t_x$, is averaged into the time $T_l$ in step 219 to generate a new average $t_l$ at step 221. If $t_x$ is greater than or equal to $t_l$, then a full flush is performed at step 223.

In one embodiment, the newly acquired time $t_x$ is used to modify the existing time $T_s$ or $T_l$ depending upon its comparative value. In one embodiment, the time, $t_x$, is then averaged into $T_s$ or $T_l$ at step 225 to generate a new $T_s$ at step 227 or $T_l$ at step 221.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments, and with various modifications, as are suited to the particular use contemplated.

What is claimed is:

1. A system for controlling the flush volume of a flushometer, comprising:

a dual flush valve associated with a waste receptacle fixture, the dual flush valve having a solid waste flush volume corresponding to a full flush volume and a liquid waste flush volume corresponding to a reduced flush volume;

a presence detection sensor associated with the flush valve, the presence detection sensor configured to monitor for the presence of a user and provide a signal upon the detection of a user in a predefined area;

an automatic flush control in communication with the presence detection sensor and the dual flush valve, the automatic flush control comprising a memory unit associated with the presence detection sensor and the flush valve, the memory unit having stored therein computer program instructions for:

receiving the presence detection sensor signal;

initiating a usage timer upon the detection of the user;

stopping the usage timer upon no longer receiving a presence detection sensor signal; generating a usage time $t_x$ that equals time elapsed from initiation to stoppage of the usage timer when the user is no longer detected;

modifying a usage cycle count $N_c$ by increasing $N_c$ by 1;

determining if a number of cycles $N_c$ is less than a predetermined number of cycles $N_p$,;

if $N_c<N_p$, then determining if the usage time $t_x$ is greater than or equal to a preset usage time value $T_p$ where if $t_x$ is greater than or equal to the preset value $T_p$, then the flush valve is opened for the full volume flush, and if $t_x$ is less than the preset value $T_p$, then the flush valve is opened for the reduced volume flush;

if $N_c>N_p$, then determining if the usage time $t_x$ is greater than or equal to a calculated average usage time $t_p$ where if $t_x$ is greater than or equal to the calculated average usage time $t_p$, then a full volume flush is performed, and if $t_x$ is less than the predetermined average usage time $t_p$, then the reduced volume flush is performed; and modifying $t_p$ according to the value of $t_x$, wherein the automatic flush control provides instructions actuating the dual flush valve for the solid waste flush volume or the liquid waste volume based on usage time.

2. The system of claim 1, wherein $T_p$ and $t_p$ further comprise a preset liquid waste use time value $T_1$ and an average liquid waste use time value $t_1$, respectively.

3. The system of claim 2, wherein modifying $t_p$ comprises modifying $t_1$ based on $t_x$ to calculate a new $t_1$.

4. The system of claim 1, wherein $T_p$ and $t_p$ further comprise a preset solid waste use time $T_s$ and an average solid waste use time value $t_s$, respectively.

5. The system of claim 4, wherein modifying $t_p$ comprises modifying $t_s$ based on $t_x$ to calculate a new $t_s$.

6. The system of claim 1, further comprising storing the time $t_x$ in a memory unit.

7. The system of claim 1, wherein detecting the user comprises the use of a sensor selected from the group consisting of infrared, capacitance, weight, thermal, motion, and combinations thereof.

8. The system of claim 1, wherein the memory unit further includes instructions to trigger a flush of a specific volume after a predetermined time even if a user is detected.

* * * * *